US005165572A

United States Patent [19]

Bath

[11] Patent Number: 5,165,572

[45] Date of Patent: Nov. 24, 1992

[54] DISPENSING CONTAINER FOR LIQUID PRODUCTS

[75] Inventor: Christopher P. Bath, Bristol, England

[73] Assignee: Sandia Investments SA, Zurich, Switzerland

[21] Appl. No.: 481,152

[22] Filed: Feb. 20, 1990

[30] Foreign Application Priority Data

Feb. 20, 1989 [GB] United Kingdom ..... 8903826

[51] Int. Cl.[5] ..... B67D 5/00

[52] U.S. Cl. ..... 222/83.5; 222/630; 222/327; 222/389; 206/204

[58] Field of Search ..... 222/83, 83.5, 89, 545, 222/389, 327, 131, 192, 145, 630; 206/204, 385, 384

[56] References Cited

U.S. PATENT DOCUMENTS

| | | | |
|---|---|---|---|
| 3,809,280 | 5/1974 | Park et al. | 206/284 X |
| 3,926,349 | 12/1975 | Schultz . | |
| 3,964,641 | 6/1976 | Langensiepen et al. . | |
| 4,193,513 | 3/1980 | Bull, Jr. . | |
| 4,212,373 | 7/1980 | Scragg | 222/89 X |
| 4,217,994 | 8/1980 | Koenig et al. . | |
| 4,615,468 | 10/1986 | Gay | 222/327 |
| 4,859,121 | 8/1989 | Deysson et al. | 222/389 X |
| 4,972,945 | 11/1990 | Insley et al. | 206/204 |

FOREIGN PATENT DOCUMENTS

| | | | |
|---|---|---|---|
| 0039245 | 11/1981 | European Pat. Off. . | |
| 0327757 | 8/1989 | European Pat. Off. . | |
| 327757 | 8/1989 | European Pat. Off. | 222/389 |
| 2246468 | 5/1975 | France . | |
| 2348859 | 11/1977 | France . | |
| 905969 | 9/1962 | United Kingdom . | |
| 1039182 | 8/1966 | United Kingdom . | |
| 1068061 | 5/1967 | United Kingdom . | |
| 1085341 | 9/1967 | United Kingdom . | |
| 2008685 | 6/1979 | United Kingdom . | |

*Primary Examiner*—Michael S. Huppert
*Assistant Examiner*—Gregory L. Huson

[57] ABSTRACT

A container for liquids is disclosed which comprises a cylinder which is initially open at both ends. One end of the cylinder is closed by a valve unit and the other end of the cylinder is closed by an end cap. The end cap has a line of weakening therein so that the package can be opened by tearing away part of the end cap. A piston is provided within the cylinder, there being between the valve unit and the piston a compartment of receiving the liquid to be dispensed. The valve unit includes a valve closure element which is spring loaded against a seat. When a force is supplied to the rear face of the piston to pressurize the liquid product in the compartment, the liquid acts on the valve closure element to urge it against its seat. Liquid can only be dispensed when an operating member, inserted into the valve unit from externally of the container, unseats the valve closure element.

6 Claims, 2 Drawing Sheets

DISPENSING CONTAINER FOR LIQUID PRODUCTS

This invention relates to packages for liquids and particularly but not exclusively to packages for harmful liquids.

According to the present invention there is provided a package for a liquid, the package comprising a cylinder which is initially open at both ends and one end of which is closed by an end cap which is secured to the cylinder, a piston within the cylinder, a valve unit closing-off the other end of the cylinder, a valve closure element of the valve unit moving to its closed position when pressure is exerted thereon by the liquid in the cylinder, and means preventing access being had to said valve element until such means is removed or penetrated.

For a better understanding of the present invention, and to show how the same may be carried into effect, reference will now be made, by way of example, to the accompanying drawings in which.

Figure 1:
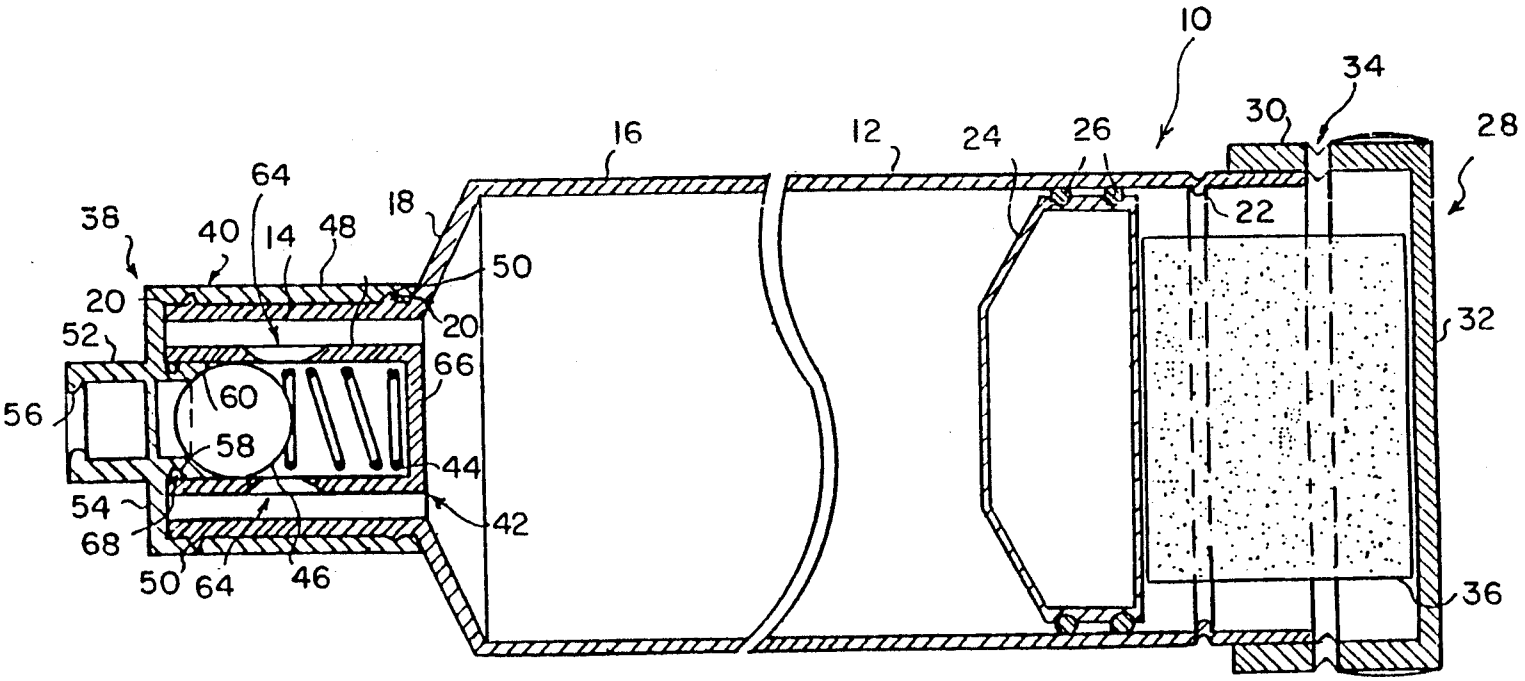
FIG. 1 is a diagrammatic cross section of a package for containing liquid such as a herbicide or pesticide.

The package illustrated in FIG. 1 is generally designated 10 and comprises a main body 12 which can be blow moulded or injection moulded in synthetic plastics material. The body 12 includes a neck 14, a cylinder 16, and a sloping shoulder 18 joining the neck 14 to the cylinder 16. The body 12 is initially open at both ends. The neck 14 is moulded externally with two annular ribs 20 and the cylinder 16 is moulded with an internal stop ring 22.

Within the cylinder 16 there is a piston 24 which is encircled by two sealing rings 26 of any suitable type. Sealing rings of the O-type are shown but it is preferred that a scraper-type ring be used.

The end of the cylinder 16 remote from the shoulder 18 is closed by means of an end cap designated 28. The end cap 28 comprises a short cylindrical portion 30 and a disc-like end wall 32. A line of weakening 34 extends around the end portion 30. As will be explained in more detail hereinafter, the end cap 28 is heat sealed or otherwise secured to the cylinder 16.

A block 36 of sponge is positioned between the piston 24 and the inner face of the end wall 32.

A combined closure and valve unit 38 is secured to the neck 14. The unit 38 comprises two moulded components designated 40 and 42, a spring 44, and a valve closure element 46 which, in the illustrated embodiment, is in the form of a ball.

The component 40 includes an outer sleeve 48 which is moulded internally with two grooves 50. The grooves 50, as the unit 38 is fitted to the neck 14, snap-engage with the ribs 20.

The component 40 further includes an inner sleeve 52 which is coaxial with the outer sleeve 48 and which extends both inwardly and outwardly from an end wall designated 54. The outer end of the sleeve 52 is formed with an internal annular rib 56 and there is an external annular groove 58 formed in the part of the sleeve 52 which is on the other side of the end wall 54. The end of the sleeve 52 remote from the rib 56 forms a seat 60 for the valve closure element 46. The part of the wall 54 which is internally of the sleeve 52 is in the form of a frangible diaphragm.

The component 42 comprises a cylinder 62 with ports 64 in the wall thereof, the cylinder 62 being closed at one end by an end wall 66. Internally of the cylinder 62 and close to the mouth thereof there is an internal annular rib 68 which enters the groove 58 as the components 40 and 42 are fitted together.

It will be noted that the spring 44 acts between the valve closure element 46 and the end wall 66.

Figure 2:
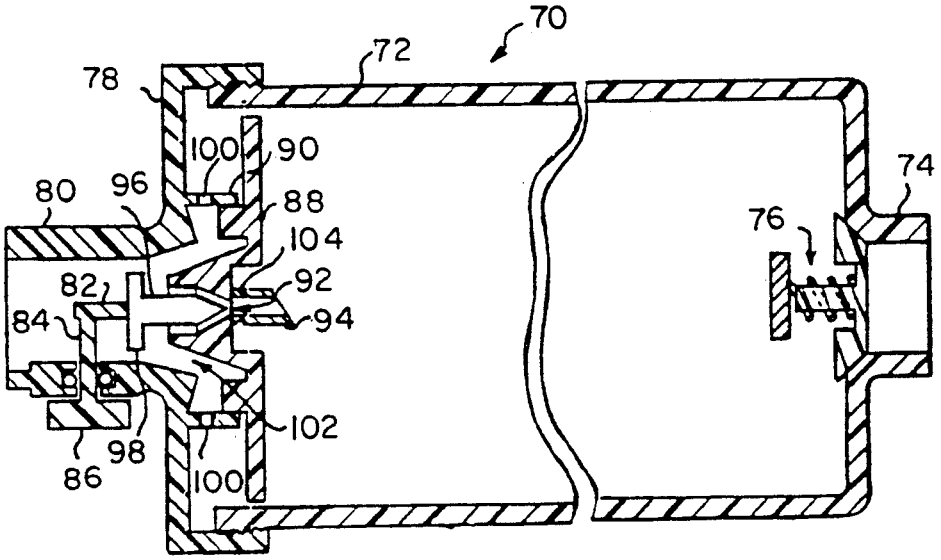
FIG. 2 is a diagrammatic cross section of a dispenser for receiving the package of FIG. 1, these two Figures not being to scale.

Turning now to FIG. 2, the dispenser illustrated is designated 70 and comprises a cylindrical main body 72 having a water inlet 74 at one end thereof. A valve 76 permits flow of water into the dispenser through the inlet 74 but prevents flow in the opposite direction. The end of the main body remote from the inlet 74 is closed by an end cap 78 which screws onto the main body. The end cap 78 includes a water outlet 80 and an eccentric cam 82 is mounted on a shaft 84 which passes through the wall of the outlet 80. An operating knob 86 is carried at the outer end of the shaft 84.

A mounting plate 88 for the package 10 is secured to an internal flange 90 of the cap 78. The plate 88 has a central bore 92 the entrance to which is defined by a cutting spike 94. A needle valve 96 is received in the bore 92 and co-operates with a conical seating surface of the bore 92. The needle valve has a head 98 which co-operates with the cam 82.

The flange 90 has bores 100 therein and there is a generally conical passageway 102 leading from the vicinity of the bores 100 to the outlet 80. The spike 94 has an external annular groove 104.

The package of FIG. 1 is assembled by pushing the piston 24 into the open end of the cylinder 26 and past the ring 22. It will be noted that the rear face of the piston 24 is flat and does not include any projection or other formation that can readily be gripped. Thus once the piston is between the shoulder 18 and the ring 22 it is impossible to get a grip on it and pull it back out of the cylinder 16. The block 36 is placed against the rear surface of the piston 24 and the end cap 28 pushed over the end of the cylinder 16. The portion 30 is then heat sealed, glued or otherwise secured to the cylinder 16.

With the package standing vertically it is filled through the neck 14. The pre-assembled unit 38 is then pressed onto the neck 14 so that the ribs 20 engage the grooves 50. The unit 38 is thus firmly secured to the neck 14 and cannot be removed unless a deliberate attempt is made to pry it off the neck. Likewise, the cap 28 securely closes the other end of the body 12.

When it is desired to dispense the contents of the package 10, the part of the end cap 28 which includes the end wall 32 is detached by tearing along the line of weakness 34. The sponge block 36 can then be removed but access to the contents of the package cannot be had through the now opened end of the cylinder 16 because it is impossible to pull the piston back beyond the ring 22.

The end cap 78 of the dispenser 70 is removed thereby exposing the spike 94. The package 10 is pushed onto the spike 94 so that the spike 94 enters the sleeve 52 and punctures the frangible diaphragm constituted by the central part of the end wall 54. The rib 56 snaps into the external groove 104 of the spike 94. The cap 78 is then resecured to the main body 72 with the dispenser 10 lying inside the main body.

When a supply of water under pressure is connected to the inlet 74, the valve 76 is opened and water flows into the main body 72. The water flows through the narrow gap between the outer periphery of the plate 88 and the inner face of the main body 72 and there is thus a pressure drop across the plate 88. The water then flows through the bores 100 in the flange 90, through the generally conical passageway 102 and impinges on the head 98 of the valve 96. The valve is thus moved to the left as viewed in FIG. 2 and the contents of the dispenser are squeezed through the central bore 92 and into the flowing water stream by water pressure acting on the exposed face of the piston 24. The rate at which the contents of the package are dispensed is dependant inter alia on the setting of the cam 82 which controls the distance through which the valve 96 may move in the opening direction.

When the package 10 is removed from the spike 94, the spring 44 urges the valve closure element 46 against its seat 60. If the cylinder 16 is not completely empty then this prevents escape of the contents of the cylinder.

The block 36 absorbs any liquid that should happen to leak past the sealing rings 26 while the package is 'on the shelf'. Furthermore should, because of improper use of the package, the user allow the liquid in the cylinder 16 to spill onto his skin, then the sponge block can be used for the purpose of wiping the affected area. The sponge can be impregnated with suitable compounds which have the effect of antidotes.

When the cylinder 16 is filled, there is still space between the piston 24 and the ring 22 which enables changes in volume due to temperature variations to be taken up without any tendency to expand the body 16. The sponge block expands to displace the piston during any period when the volume of the contents is decreasing due to a temperature drop.

The spring 44 can be of metal but is preferably of synthetic plastics material. The valve closure element 46 could be cylindrical in form or could be constituted by a flap. The space within the sleeve 52 between the walls 54 and the rib 56 can be filled with a gel through which the spike 94 passes, and which assists in re-sealing the package when the spike is withdrawn.

The line of weakening 34 can be omitted which means that to open the package it is necessary to cut through the end cap 28. The sleeve 48 can be heat sealed, glued or ultransonically welded to the neck 14 instead of being snap-fitted to it.

The cylinder 16 can be of transparent material and can have thereon markings which, in conjunction with the piston 24, indicates the volume of liquid which has been dispensed or which remains.

The diaphragm portion of the end wall 54 can be omitted and a closure cap secured to the sleeve 52. The cap can be fitted in such a way that it must be ripped or cut to remove it. Where a diaphragm is provided, then there can be a simple screw-on end cap.

Figure 3:
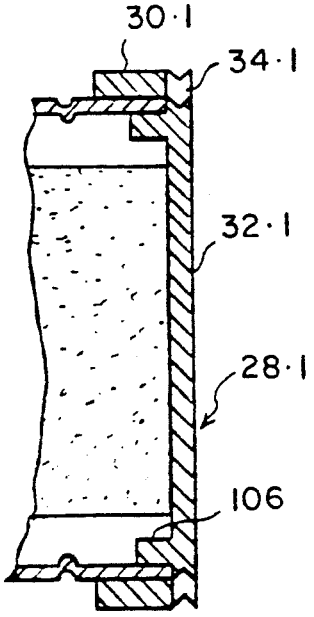
FIG. 3 illustrates a modified form of end cap for the package.

In the modified embodiment of FIG. 3 the end cap 28.1 includes an internal flange 106 which is located inside the cylinder 16. The cylinder 16 and flange 106 are formed with interlocking ribs and grooves (not shown). When the end cap 28.1 is broken along the line of weakening 34.1, the portion 30.1 remains outside the cylinder 16 and the disc-like end wall 32.1 of the cap, together with the flange 106, are detached. Once the contents of the package have been dispensed, the cap 28.1 can be pressed into the end of the cylinder so that the ribs and grooves provided inter-engage thereby closing off the end of the cylinder 16.

The block 36 will normally be of foamed synthetic plastics material and not natural sponge.

I claim:

1. A container for a liquid product which is to be dispensed into a flowing liquid, the container comprising;

a cylinder;

a piston in said cylinder;

an end cap secured to the cylinder and closing one end of the cylinder, there being a line of weakening along which part of the end cap can be separated from the cylinder and the remainder of the end cap thereby to permit access to be had to the interior of the cylinder through said one end;

a valve unit closing-off the other end of the cylinder;

a compartment for said product bounded by said cylinder, said piston and said valve unit;

a valve closure element forming part of said valve unit;

a valve seat forming part of said valve unit;

spring means forming part of said valve unit and urging said valve closure element against said seat;

a surface of said valve closure element which is contacted by the product in such manner that the product, when under pressure, urges said element towards said seat; and wall means for defining a passage through which a member can be inserted into said valve unit to displace said valve closure element away from said seat against the action of the spring means and permit flow of said product from said compartment through said valve unit to externally of said container.

2. A container according to claim 1 and which includes a sponge block which is under compression and which is between said piston and said end cap.

3. A container according to claim 1, in which said end cap includes two parts with said line of weakening between them, one of said parts being attached to said cylinder and the other part prior to dispensing of said product being detached from said one part to permit access to be had to the interior of said cylinder.

4. A container according to claim 3, in which said cap includes a disc-like end portion and a cylindrical portion which receives said one end of the cylinder, said cylindrical portion being connected to said cylinder and said line of weakening being between said cylindrical portion and said disc-like end portion whereby said disc-like end portion is detached when the closure cap is divided along said line of weakening.

5. A container according to claim 4 and including a circumferentially extending, inwardly protruding rib on the inner face of said cylinder between said piston and said one end for inhibiting removal of said piston through said one end of the cylinder.

6. A container according to claim 1, in which a frangible diaphragm is provided across said passage, which diaphragm prevents said member reaching said valve closure element until the diaphragm is punctured.

* * * * *